United States Patent [19]

Baron et al.

[11] Patent Number: 4,655,722

[45] Date of Patent: Apr. 7, 1987

[54] WATER SPOUTING INFLATABLE BOP BAG

[75] Inventors: William J. Baron, New York; Marie F. Gredel, Middle Village, both of N.Y.

[73] Assignee: Kid Biz, Inc., New York, N.Y.

[21] Appl. No.: 772,442

[22] Filed: Sep. 4, 1985

[51] Int. Cl.[4] ..... A63H 3/06; A63H 13/18; B05H 1/00

[52] U.S. Cl. ..... 446/226; 446/325; 446/156; 239/211

[58] Field of Search ..... 239/211, 273, 275, D 1; 446/153, 156, 178, 199, 211, 220, 224, 226, 325

[56] References Cited

U.S. PATENT DOCUMENTS

| | | | |
|---|---|---|---|
| 1,630,137 | 5/1927 | Ruwwe | 446/325 |
| 1,893,507 | 1/1933 | Ranney | 446/156 |
| 2,554,516 | 5/1951 | Anthony | 446/325 |
| 2,632,977 | 3/1953 | Valasek | 446/325 |
| 2,801,850 | 8/1957 | Yount | 446/220 X |
| 2,968,120 | 1/1961 | Reed | 239/211 X |
| 2,995,864 | 8/1961 | Werelius, Jr. | 446/211 |
| 3,026,648 | 3/1962 | Lemelson | 446/226 |
| 3,163,419 | 12/1964 | Lemelson | 446/325 |
| 4,078,792 | 3/1978 | Arato | 239/211 X |
| 4,205,785 | 1/1980 | Stanley | 239/211 X |
| 4,235,378 | 11/1980 | Melin et al. | 446/153 X |
| 4,268,030 | 5/1981 | Richards | 446/226 X |
| 4,352,461 | 10/1982 | Orta et al. | 239/211 |
| 4,550,876 | 11/1985 | Kulesza et al. | 239/211 |

*Primary Examiner*—Robert A. Hafer
*Assistant Examiner*—D. N. Muir
*Attorney, Agent, or Firm*—Charles E. Baxley

[57] ABSTRACT

A water toy includes an inflatable housing having ballast in the lower portion thereof. A spray head is connected to the top of the housing and water is conveyed to the spray head from a garden hose through a tube in the housing. With water spraying from the top of the housing, the toy can be hit from an initial upright position so as to tilt to various angles but will resume its initial upright position.

7 Claims, 2 Drawing Figures

WATER SPOUTING INFLATABLE BOP BAG

BACKGROUND OF THE INVENTION

The invention relates generally to water toys and in particular to a toy which is constructed to emit water in various directions as the toy is struck.

More particularly, the invention relates to a gas inflatable punching bag toy known as a Bop bag. The bop bag stands freely on a surface and it is ballasted so that when it is struck by a player, it is displaced from an initial stable upright position, then the weight of the ballast returns the bop bag to the initial position.

Various types of water emitting devices arranged in various configurations are well known. U.S. Pat. No. 4,235,378 describes a water toy which includes a housing having a cap affixed to the top of the housing, a hose coupling projecting from the bottom of the housing which is adapted to be connected to a hose and a tube extending through the interior of the toy coupling water from the water hose to the cap. The cap includes a chamber communicating with a number of nozzles to which are affixed flexible tubing extending from the toy. In operation, water flow through the internal tube and out of the flexible tubes extending from the top of the toy cause the tubes to twist and produce a pattern of water surrounding the toy. The toy however is adapted to remain upright on a supporting surface when in use. Other toys exist which have ballast in the bottom of the toy which causes the toy to return to an upright position when it is hit by a child playing with the toy.

SUMMARY OF THE INVENTION

In accordance with the present invention, a water toy includes a housing which is adapted to be supported on a surface and which has an inlet end adapted to be coupled to a water supply under pressure and an outlet end for permitting water to escape from the housing. A tube is positioned within the housing and coupled between the inlet end and outlet end for conveying water therebetween. The housing further includes ballast means positioned in the housing such that when the housing is displaced from an initial stable position, the ballast means will cause the housing to return to its initial stable position.

In a particular and preferred embodiment of the invention, the housing is gas inflatable and contains a first compartment, adapted to receive air under pressure, and a second compartment. The second compartment is positioned proximate the end of the housing which is adapted to be supported on the surface and is filled with ballast material, which is preferably water.

It is therefore the object of the present invention to provide a new and improved water toy.

It is another object of the present invention to provide a novel water toy which permits water to be sprayed from the toy and permits the toy to be hit so that the spray can be directed toward particular locations and yet will permit the toy to return to its original position so that it can be hit again.

These and other objects and features of the present invention will be understood as well as a fuller understanding of the invention being realized by referring to the following description of the presently preferred embodiment thereof taken in conjunction with the accompanying drawings in which:

DESCRIPTION OF THE PREFERRED EMBODIMENT

Figure 1:
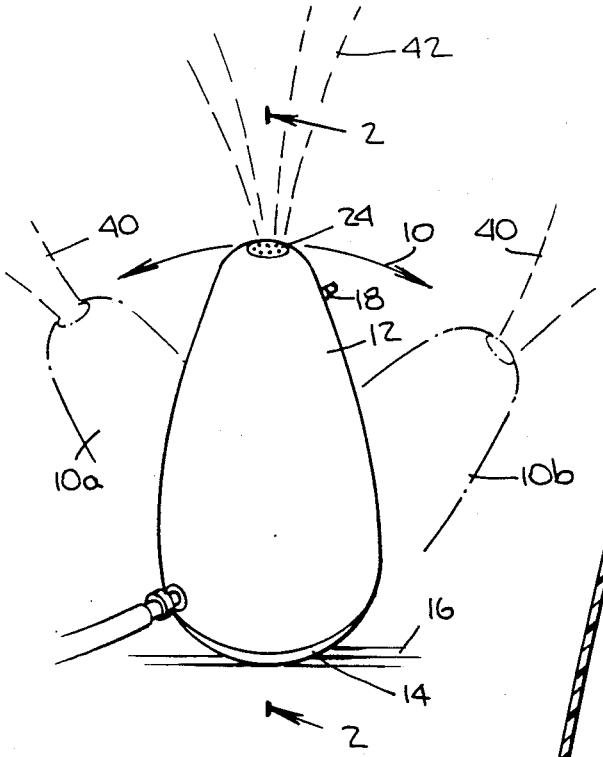
FIG. 1 is an isometric elevational view of the invention showing the initial stable position of the toy in full line and representative unstable positions of the toy in dotted line.

Referring now to FIG. 1, the toy 10 generally includes housing 12, which is shown in the drawings as conically shaped with a rounded bottom 14 but which can be any desired shape. The toy is adapted to be placed on any surface 16 such as the ground and assume a stable upright position such as shown in full line in FIG. 1. An air valve 18 is provided in the wall of housing 12 and a fitting 20 is also connected to the wall of housing 12 and adapted to be connected to garden hose 22. A spray head 24 is mounted in the top of housing 12.

Figure 2:
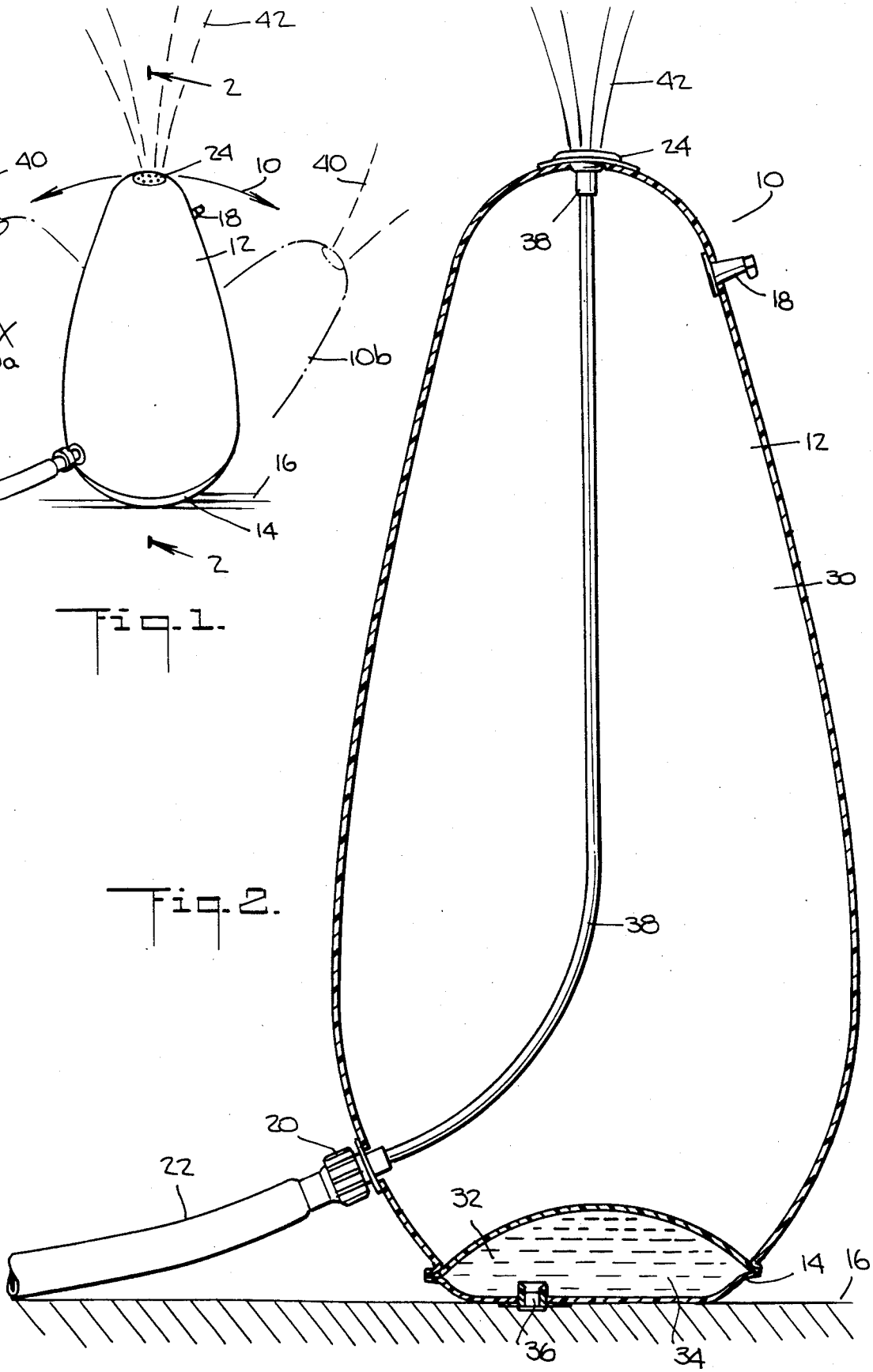
FIG. 2 is a sectional view taken along line 22 of FIG. 1 and looking in the direction of the arrows.

Preferably, housing 12 is formed of an air inflatable vinyl material which, as seen in FIG. 2 is divided into first compartment 30 and second compartment 32. First compartment 30 is filled with air which is inserted into compartment 32 via valve 18. Second compartment 32 is filled with a ballast material 34 through plug 36. Preferably, ballast material 34 is water. A vinyl tube 38 extends between fitting 20 and a fitting 40 which couples tube 38 to spray head 24.

In operation, garden hose 22 is attached to fitting 20. Water passing through garden hose 22 passes through tube 38 connector 40 and spray head 24 causing water to be sprayed through spray head 24 as indicated by arrows 42. When the toy is struck, it assumes for example one of the positions shown in FIG. 1 (e.g., 10*a* or 10*b*) and water is sprayed from the toy in different directions. The ballast 34 in compartment 32 causes the toy to assume its upright initial position after being hit into the positions 10*a* or 10*b*.

While only a present preferred embodiment of the invention has been described, modifications and improvements thereto can be made while still coming within the spirit and scope of the invention which is set forth in the amended claims.

What I claim is:

1. A bop bag comprising;

an elongated housing with an upper end and a rounded lower end adapted to rock randomly on a substantially flat surface, the housing having a diaphragm sealed therein to define an upper gas compartment and a lower ballast compartment, the housing provided with an air valve for introducing air under pressure into the gas compartment to inflate the bop bag, the housing provided with a water port for introducing water ballast into the ballast compartment whereby when the inflated bop bag is displaced from an initial stable upright position the weight of the water ballast returns it thereto, the water port offset from a central axis of the lower end and having a flat plug whereby the bop bag is enabled to rock randomly on a flat surface, the housing fitted remotely from the upper end with a hose coupling disengageably coupleable to a source of water under pressure and a spray head in the vicinity of the upper end to provide a water spout issuing therefrom so that the water spout changes direction as the bop bag rocks, a tube in the gas compartment connecting the hose coupling in flow series with the spray head for delivering a flow of the water thereto.

2. A bop bag comprising;

a housing having an upper gas compartment and a lower ballast compartment, inflation means for introducing gas under pressure into the gas compartment to inflate the bop bag, means for introducing ballast into the ballast compartment whereby when the inflated bop bag is displaced from an initial stable upright position the ballast returns it thereto, the housing provided with water inlet means disengageably coupleable to a supply of water under pressure and water outlet means arranged to spout the water from the housing so that a water spout changes direction as the bop bag rocks, and water delivery means for delivering a flow of the water from the water inlet means to the water outlet means.

3. A bop bag comprising;

an elongated housing generally having an upper end and a lower end and having an upper gas compartment and a lower ballast compartment, inflation means for introducing air under pressure into the gas compartment to inflate the bop bag, means for introducing ballast into the ballast compartment whereby when the inflated bop bag is displaced from an initial stable upright position the ballast returns it thereto, the housing provided with water inlet means in proximity with the lower end and disengageably coupleable to a supply of water under pressure and water outlet means in proximity with the upper end arranged to spout the water from the housing so that a water spout changes direction as the bop bag rocks, and water delivery means within the housing for delivering a flow of the water from the water inlet means to the water outlet means.

4. A bop bag comprising an elongated housing with an upper end and a rounded lower end and adapted to rock randomly on a substantially flat surface, the housing having a diaphragm sealed therein to define an upper gas compartment and a lower ballast compartment, the housing provided with an air valve for introducing air under pressure into the gas compartment to inflate the bop bag, the ballast compartment adapted to receive ballast therein whereby when the inflated bop bag is displaced from an initial stable upright position weight of the ballast returns it thereto;

an improvement comprising the following:

the housing fitted remotely from the upper end with a hose coupling disengageably coupleable to a source of water under pressure and water outlet means in the vicinity of the upper end to allow a water spout to issue therefrom so that the water spout changes direction as the bop bag rocks, a tube in the housing connecting the hose coupling in flow series with the water outlet means for delivering a flow of the water thereto, the housing provided with a water port for introducing water into the ballast compartment to serve as the ballast.

5. The bop bag of claim 4 with the water outlet means being a spray head.

6. The bop bag of claim 5 with the hose coupling penetrating the housing via the gas compartment remote from the upper end.

7. The bop bag of claim 6 with the water port offset from a central axis of the lower end and having a flat plug whereby the random rocking of the bop bag is not impeded.

* * * * *